US006500361B1

(12) United States Patent
Matsumora

(10) Patent No.: US 6,500,361 B1
(45) Date of Patent: Dec. 31, 2002

(54) CONDUCTIVE RESIN COMPOSITION AND ENCODER SWITCH USING THE SAME

(75) Inventor: Satoru Matsumora, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 118 days.

(21) Appl. No.: 09/630,520

(22) Filed: Aug. 2, 2000

(30) Foreign Application Priority Data

Aug. 2, 1999 (JP) ..... 11-218713

(51) Int. Cl.[7] ..... H01B 1/24
(52) U.S. Cl. ..... 252/511; 524/496; 200/237
(58) Field of Search ..... 252/511; 524/495, 524/496; 200/237; 337/14

(56) References Cited

U.S. PATENT DOCUMENTS 5,084,211 A * 1/1992 Kawaguchi et al. ..... 252/511
5,219,494 A 6/1993 Ambros et al.
5,549,849 A * 8/1996 Namura et al. ..... 252/503

FOREIGN PATENT DOCUMENTS

DE 39 42 799 A1 6/1991
JP 02329226 (Abstract) 11/1992
JP 2772044 4/1998

OTHER PUBLICATIONS

XP–002163699, Database WPI, Section Ch, Week 199941, Derwent Publications Ltd., London, GB; AN 1992–213942 and JP 02 943114 B (Tokai Rubber Ind. Ltd.), Aug. 30, 1999.

* cited by examiner

*Primary Examiner*—Mark Kopec
(74) *Attorney, Agent, or Firm*—Brinks Hofer Gilson & Lione

(57) ABSTRACT

A conductive resin composition that is rendered both highly conductive and wear resistant, and accommodable to fine pattern forming is provided. The conductive resin composition contains carbon beads and carbon black as a conductive filler in phenolic resin served as a binder resin, wherein the conductive filler content is in the range from 34 to 60% by weight, both excellent conductivity and wear resistance can be obtained thereby. Furthermore, by partially replacing the binder resin with xylenic resin, fine pattern forming is realized while the excellent conductivity and wear resistance are maintained.

6 Claims, 4 Drawing Sheets

CONDUCTIVE RESIN COMPOSITION AND ENCODER SWITCH USING THE SAME

BACKGROUND OF THE INVENTION

1. Field of the Invention

This invention relates to conductive resin composition excellent in wear resistance and conductivity and an encoder switch that uses this conductive resin composition.

2. Description of the Related Art

Conventional conductive resin composition used for encoder switches that is prepared by a method in which heat resisting resin such as phenol resin, phenol-aralkyl resin, or polyimide resin is dissolved in an organic solvent to prepare a resin solution, conductive filler such as graphite, carbon black, or carbon fiber is mixed and dispersed in the resin solution to prepare a conductive ink, and the conductive ink is coated on a substrate consisting of material such as Bakelite or alumina by means of screen printing has been used. Conductive carbon black such as acetylene black, Ketjen black or furnace black is generally used as the conductive filler. If the product is required to be rendered more conductive, graphite is added, and if the product is required to be rendered more wear resistant, carbon fiber is added.

However, as the electronic parts have been required to be miniaturized and rendered long life recently, the material described hereinabove has been insufficient for these requirements. In detail, in the case of the material containing graphite, the product is easily shaved because of cleavage characteristic of graphite, and the service life of an encoder switch that employs a conductive resin composition containing graphite is as short as 10,0000 cycles or less because of poor wear resistance of the material. The conductive resin composition containing carbon fiber cannot be employed in applications that involve a fine pattern due to miniaturization of electronic parts because of dimensional problems including a diameter of several $\mu$m and length of several ten $\mu$m (though the sliding characteristic is good because of the hardness of the carbon fiber.) A trial in which graphite fibril or carbon nanotube, namely fine carbon fiber, is used has been made, but the sliding resistance is not improved because the entanglement of fine carbon fiber cannot be disentangled in a resin solution. Furthermore, expensive cost of fine carbon fiber is also the barrier for application.

It is the object of the present invention to provide conductive resin composition excellent in wear resistance and conductivity and accommodable for fine pattern.

SUMMARY OF THE INVENTION

Conductive resin composition of the present invention contains conductive filler such as carbon beads and carbon black in a binder resin consisting of phenol resin, and the content of the conductive filler ranges from 34 to 60% by weight.

The binder resin allows carbon beads or carbon black to disperse homogeneously therein and cure-shrinks to thereby increase the contact pressure between conductive filler particles, and to reduce the contact resistance between particles, and as the result the conductivity is improved. To obtain the effect described hereinabove, phenolic resin is preferably used as the binder resin. Phenol resin gives sufficient cure shrinkage, the cure shrinkage renders the contact pressure between conductive filler high and the contact resistance between particles low, and thus the conductivity of the conductive resin compound is improved.

Examples of the phenolic resin include, for example, resol-type phenol resin, novolak-type phenol resin, phenol aralkyl resin, xylene-modified phenol resin, cresol-modified phenol resin, furan-modified phenol resin, epoxy-phenol resin, and phenol-melamine resin.

Carbon beads render the conductive resin composition conductive and play a role as the structural material for improving the wear resistance of a slide brush consisting of the conductive resin composition that bears the weight of the slide brush.

If carbon beads only are used as the conductive filler of the conductive resin composition, the conductivity of the conductive resin composition is low because of not many contact points between particles due to spherical shape of the carbon beads and high resistance of the carbon beads itself.

Use of carbon beads and carbon black together as the conductive filler of the conductive resin composition allows carbon black to interpose between carbon beads to thereby increase the contact point between conductive fillers, and thus plays a role to improve the conductivity of the conductive resin composition.

When conductive resin composition containing carbon beads as the structural material is used for an encoder switch, projections of carbon beads and recesses of binder resin are formed on the conductive resin composition surface namely the sliding surface of the slide brush. When a slide brush rides on a projection, noise is generated in the output signal of the encoder switch. Furthermore, because carbon beads are too hard, the carbon brush wears due to sliding-contact with carbon beads to result in shortened service life of the encoder switch.

Use of carbon beads and carbon black together as the conductive filler of the conductive resin composition renders the recess conductive because carbon black interpose between carbon beads. Furthermore, because carbon black adheres on the carbon bead surface, the direct contact between the slide brush and carbon beads is avoided.

The content of the conductive filler, containing carbon black and carbon beads, of the conductive resin composition lower than 35% by weight results in the low conductivity and high specific resistance of the conductive resin composition due to insufficient quantity of the conductive filler.

If such conductive resin composition having high specific resistance is used for an encoder switch, a fixed resistor having high resistance must be used as the pull-up resistance used for obtaining the pulse waveform. Therefore, a current flows little when turned on, and the effect of the external noise becomes effective.

On the other hand, the content of the conductive filler, containing carbon black and carbon beads, of the conductive resin composition exceeding 60% by weight result in the insufficient increase of contact pressure between conductive filler particles due to cure shrinkage of binder resin and results in the high contact resistance between particles because of insufficient quantity of the binder resin, and thus results in the low conductivity. Furthermore, the insufficient quantity of the binder resin renders the conductive resin composition brittle. If such conductive resin composition is used for an encoder switch, the slide brush slides on the conductive resin composition to result in the breakdown of the conductive resin composition and results in shortened service life of the encoder switch.

The conductive filler content in the conductive resin composition of the present invention preferably ranges from 45 to 51% by weight. The conductive filler content in the range as described hereinabove brings about the low specific resistance and also long service life of an encoder switch for which the conductive resin composition is used.

In the conductive resin composition of the present invention, the ratio of the carbon beads to the carbon black is preferably 1 to 8 by weight. The ratio of carbon beads to carbon black as described hereinabove renders the conductive resin composition both conductive and wear resistant, and both the less noise output signal and the long service life of the encoder switch for which such conductive resin composition is used are realized.

In the conductive resin composition of the present invention, the carbon beads are spherical, and particle diameter of the carbon beads ranges preferably from 1 to 30 $\mu$m. Because the carbon beads are spherical, the sliding surface of a slide brush is covered with an aggregation of spherical surface, and the slide brush wears little.

The carbon beads having the particle diameter smaller than 1 $\mu$m cannot bear the weight of the slide brush, the wear resistance of the conductive resin composition is poor, on the other hand the carbon beads having the particle diameter larger than 30 $\mu$m results in the projection of the carbon beads from the border of the conductive pattern formed of the conductive resin composition, and results in the poor pattern size accuracy.

In the present invention, the conductive resin composition contains the carbon beads that are formed by heating and carbonizing thermosetting resin powder, at that time the heat treatment temperature is in a range from 700 to 1200° C. Such carbon beads are accurately spherical and conductive.

For example, phenol resin, benzo-guamine or the like may be used as the thermosetting resin. The heat treatment temperature for treating the thermosetting resin lower than 700° C. results in the insufficient carbonization of the thermosetting resin and the high specific resistance of the resultant carbon beads, and thus results in the poor conductivity of the conductive resin composition. On the other hand, the heat treatment temperature higher than 1200° C. results in the cleavage of the carbon beads due to strained rearrangement of molecules during carbonization like cracked pomegranate. Edges of the cleaved carbon beads projected on the surface of the conductive resin composition cause wear of a slide brush.

The conductive resin composition of the present invention contains carbon beads and carbon black in the carbon binder resin comprising xylenic resin and phenolic resin, and the ratio of the phenolic resin to the xylenic resin ranges preferably from 1 to 33 by weight.

Xylenic resin is served as not only as the binder resin but also as a functional resin for rendering the theological characteristic of the conductive ink that contains the conductive resin composition and organic solvent suitable for fine pattern forming by means of screen printing.

Generally in the dispersion that contains particles, the larger the particle diameter is and the more spherical the particles are, the higher the flow property is. Because generally the carbon bead is perfectly spherical in shape and has a particle diameter equal to or larger than 1 $\mu$m, the fluidity of the conductive ink comprising the conductive resin composition containing the carbon beads and an organic solvent is high. Too high fluidity of the conductive ink results in the sagging and bleeding of the ink at the edge of the pattern when the ink is screen-printed to form a conductive pattern, and such conductive ink is not suitable for forming a fine pattern.

The ink containing xylenic resin behaves as described hereunder in screen printing process. The viscosity is low while the ink is being subjected to a load loaded by means of a squeegee against a screen so that the ink is suitable for printing, on the other hand the viscosity becomes high so that the ink does not sag after the ink is extruded through the screen mesh and the load is unloaded. As the result, because the conductive ink maintains the pattern shape continuously as screen printed, it is possible to form a fine pattern.

The ratio of phenolic resin to xylenic resin smaller than 1 by weight, that is, in the case where the proportion of phenolic resin is larger than the proportion of xylenic resin, results in the separation of xylenic resin from the phenolic resin and the bleeding of the xylenic resin on the conductive resin composition. On the other hand, the ratio of phenolic resin to xylenic resin larger than 33 by weight, that is, in the case where the proportion of phenolic resin is large and the proportion of xylenic resin is small, results in the delayed restoration time from extrusion of the conductive ink through the screen mesh to restoration of high viscosity, and could result in the sagging and bleeding of the pattern edge.

Because the conductive resin composition of the present invention as described hereinabove is used for an encoder switch of the present invention, in the case of the encoder switch of the present invention, the signal noise is little and the service life is long, and the small-sized encoder switch is realized because the fine conductive pattern can be formed.

DETAILED DESCRIPTION OF THE PREFERRED EMBODIMENTS

Figure 1:
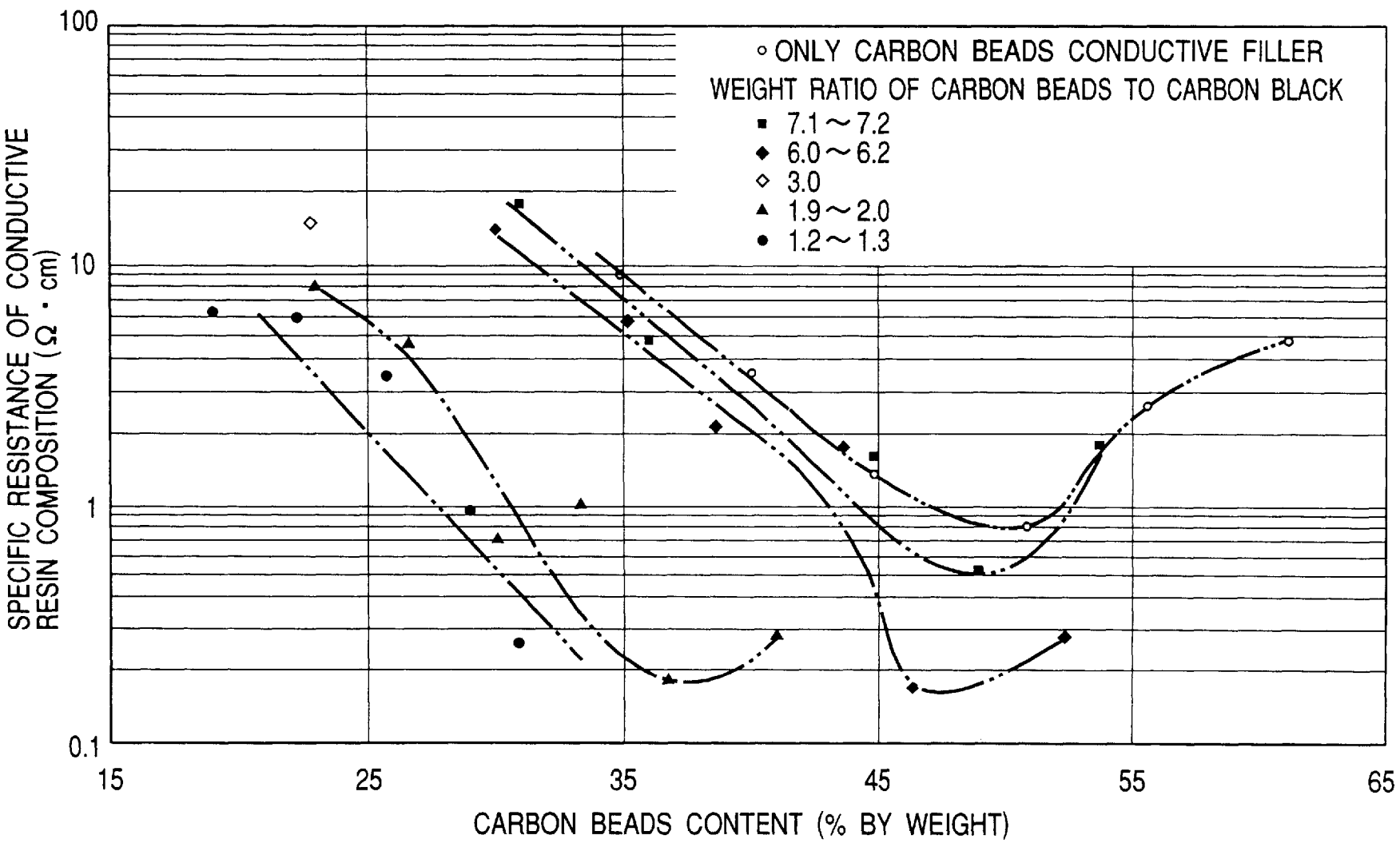
FIG. 1 is a graph showing the specific resistance of conductive resin compositions of the present invention.

Next, embodiments of conductive resin composition in accordance with the present invention will be described. In the present embodiment, the conductive resin composition of the present invention contains carbon beads and carbon black that are served as the conductive filler in the binder resin consisting of phenolic resin or a mixture of phenolic resin and xylenic resin, wherein the content of the conductive filler ranges from 34 to 60% by weight.

EXAMPLE 1

Example 1 in which resol-type phenolic resin is used as the binder resin of the abovementioned conductive resin composition will be described. Prepared conductive resin composition samples were different in the conductive filler content listed in d-column and different in the weight ratio of carbon black to carbon beads listed in e-column as shown in table 1.

TABLE 1

| No. | A | B | C | D | E | F | G1 | G2 | G3 | H1 | H2 | H3 | |
|---|---|---|---|---|---|---|---|---|---|---|---|---|---|
| 1 | 9.02 | 2.99 | 27.6 | 30.3 | 3 | 11 To 17.7 | Ng | Ng | — | Ng | Ng | — | Comparative Example |
| 2 | 12.02 | 10.19 | 41.42 | 34.9 | 1.2 | 3.73 To 8.86 | Ng | Ok | — | Ok | Ok | 5 | Example |
| 3 | 11.98 | 6.34 | 34.01 | 35 | 1.9 | 5.54 To 10.3 | Ng | Ok | — | Ok | Ok | 5 | Example |
| 4 | 12.01 | 1.97 | 26.22 | 34.8 | 6.1 | 10.8 To 16.2 | Ng | Ng | — | Ok | Ok | 8 | Example |
| 5 | 12 | 1.67 | 25.41 | 35 | 7.2 | 10 To 26.8 | Ng | Ng | — | Ok | Ok | 8 | Example |
| 6 | 12.02 | 10.06 | 32.25 | 40.6 | 1.2 | 2.85 To 8.76 | Ok | Ok | 7 | Ok | Ok | 9 | Example |
| 7 | 12.01 | 6.39 | 27.28 | 40.2 | 1.9 | 1.98 To 7.22 | Ok | Ok | 7 | Ok | Ok | 9 | Example |
| 8 | 11.98 | 1.92 | 20.04 | 41 | 6.2 | 2.56 To 9.01 | Ok | Ok | 8 | Ok | Ok | 10 | Example |
| 9 | 12.01 | 1.69 | 19.66 | 41.1 | 7.1 | 1.56 To 7.78 | Ok | Ok | 8 | Ok | Ok | 10 | Example |
| 10 | 12.04 | 9.12 | 25.95 | 44.9 | 1.3 | 2.65 To 3.97 | Ok | Ok | 10 | Ok | Ok | 11 | Example |
| 11 | 11.96 | 6.01 | 21.93 | 45 | 2 | 0.446 To 0.981 | Ok | Ok | 12 | Ok | Ok | 20 | Example |
| 12 | 11.99 | 1.99 | 17.11 | 45 | 6 | 1.65 To 2.63 | Ok | Ok | 13 | Ok | Ok | 22 | Example |
| 13 | 12 | 1.7 | 16.79 | 44.9 | 7.1 | 2.01 To 4.22 | Ok | Ok | 15 | Ok | Ok | 22 | Example |
| 14 | 12 | 9.76 | 17.09 | 51.1 | 1.3 | 0.183 To 0.333 | Ok | Ok | 14 | Ok | Ok | 15 | Example |
| 15 | 12.03 | 5.8 | 14.88 | 51 | 1.9 | 0.148 To 0.206 | Ok | Ok | 12 | Ok | Ok | 18 | Example |
| 16 | 11.99 | 2.01 | 11.78 | 51 | 6 | 0.113 To 0.221 | Ok | Ok | 16 | Ok | Ok | 24 | Example |
| 17 | 12 | 1.67 | 10.68 | 51.2 | 7.1 | 0.408 To 0.603 | Ok | Ok | 13 | Ok | Ok | 16 | Example |
| 18 | 12.02 | 9.18 | 20.31 | 56 | 1.2 | 0.85 To 1.01 | Ok | Ok | 12 | Ok | Ok | 15 | Example |
| 19 | 12.02 | 6.39 | 17.7 | 54.5 | 2 | 0.92 To 1.11 | Ok | Ok | 11 | Ok | Ok | 13 | Example |
| 20 | 12.11 | 2.01 | 13.59 | 54.3 | 6 | 1.45 To 2.04 | Ok | Ok | 10 | Ok | Ok | 12 | Example |
| 21 | 12.03 | 1.7 | 13.1 | 56.1 | 7.1 | 1.21 To 1.97 | Ok | Ok | 10 | Ok | Ok | 11 | Example |
| 22 | 11.99 | 5.88 | 11.25 | 61.4 | 2 | 0.165 To 0.402 | Ok | Ok | 1 | Ok | Ok | 1 | Comparative Example |
| 23 | 12 | 1.99 | 8.85 | 61.3 | 6 | 0.112 To 0.441 | Ok | Ok | 1 | Ok | Ok | 3 | Comparative Example |
| 24 | 12 | 1.7 | 8.68 | 61.2 | 7.1 | 1.13 To 2.56 | Ok | Ok | 1 | Ok | Ok | 3 | Comparative Example |
| 25 | 12.09 | 0 | 22.49 | 35 | — | 3.94 To 13.5 | Ng | Ng | — | Ok | Ok | <1 | Comparative Example |
| 26 | 12 | 0 | 17.8 | 40.3 | — | 1.73 To 5.25 | Ng | Ng | — | Ok | Ok | <1 | Comparative Example |
| 27 | 11.91 | 0 | 14.61 | 44.9 | — | 0.871 To 1.72 | Ng | Ng | — | Ok | Ok | <1 | Comparative Example |
| 28 | 12.12 | 0 | 11.62 | 51.1 | — | 0.588 To 0.999 | Ng | Ng | — | Ok | Ok | <1 | Comparative Example |
| 29 | 12.08 | 0 | 9.6 | 55.7 | — | 1.94 To 3.14 | Ng | Ng | — | Ok | Ok | <1 | Comparative Example |
| 30 | 12.57 | 0 | 7.83 | 61.6 | — | 2.98 to 6.4 | NG | NG | — | OK | OK | <1 | Comparative Example |

A quantity of carbon beads (g)
B quantity of carbon black (g)
C quantity of resol-type resin (g)
D content of conductive filler (% by weight)
E weight ratio of carbon beads to carbon black
F specific resistance (Ω · cm)
G1 initial output of encoder switch with fixed resistance of 10 kΩ
G2 initial noise of encoder switch with fixed resistance of 10 kΩ
G3 life (10,000 cycles) of encoder switch with fixed resistance of 10 kΩ
H1 initial output of encoder switch with fixed resistance of 100 kΩ
H2 initial noise of encoder switch with fixed resistance of 100 kΩ
H3 life (10,000 cycles) of encoder switch with fixed resistance of 100 kΩ

The carbon beads described hereinabove were prepared as described hereunder. Resin powder (commercially available) having the particle diameter distribution from 1 to 30 μm (the average particle diameter is 10 μm) prepared by curing thermosetting phenolic resin emulsion in solution or by curing atomized thermosetting phenolic resin solution was heated at a heating rate of 6° C./minute in an nitrogen atmosphere and maintained at the peak temperature of 1100° C. for one hour and self-cooled.

Conductive filler was dispersed in a resin solution, that had been formed by dissolving the resol-type phenolic resin in carbitol, by means of three-roller roller mill to prepare a conductive ink, and the conductive ink was printed in the pattern on a substrate by means of screen printing, heated at 200° C. for 20 minutes, and dried and cured, and thus a sample of the conductive resin composition was obtained.

The abovementioned conductive ink was printed in the rectangular pattern on an alumina substrate by means of screen printing using a mask of 200 mesh Tetron, and dried and cured to form an sample of the conductive resin composition. The resistance value of the conductive resin composition sample was measured and the thickness of the conductive resin composition was measured, and the resistance value was converted to a specific resistance as listed in f-column of Table 1.

As obvious from Table 1, in the case of conductive resin composition samples of No. 2 to No. 30 having the conductive filler content (d-column) of approximately 34.8 to 61.6% by weight, the minimum variation of measured specific resistance (f-column) is approximately 10 Ω·cm or smaller, and these samples are suitably used as the conductive resin composition. In particular, in the case of conductive resin composition samples No. 10 to No. 24 having the conductive filler content (d-column) of approximately 45 to 61% by weight, the minimum variation of measured specific resistance (f-column) is approximately 2 Ω·cm or smaller, and the conductivity is particularly excellent.

Next, the variation of specific resistance of the conductive resin composition with changing of the added quantity of carbon black in the conductive filler containing carbon beads mainly will be described with reference to a graph of FIG. 1. In the graph of FIG. 1, the ordinate indicates the average value of specific resistance of the conductive resin composition samples No. 1 to No. 30, and the abscissa indicates the carbon beads content (% by weight) based on the whole conductive resin composition. It is obvious from the graph that the specific resistance decreases as the carbon black content increases when carbon black was added to the conductive resin composition having a constant carbon beads content, namely, approximately in the order of the weight ratio from 7.1~7.2 (■), to 6.0~6.2 (♦), 1.9~2.0 (▲), and 1.2 to 1.3 (●). The specific resistance of the conductive resin composition having the ratio of carbon beads to carbon black of approximately 7.1 to 7.2 is lower than the specific resistance of the conductive resin composition containing only the carbon beads conductive filler. From this fact, it is found that the carbon black content equal to or higher than ⅛ of the conductive filler is effective for improving the conductivity of the conductive resin composition.

Figure 2:
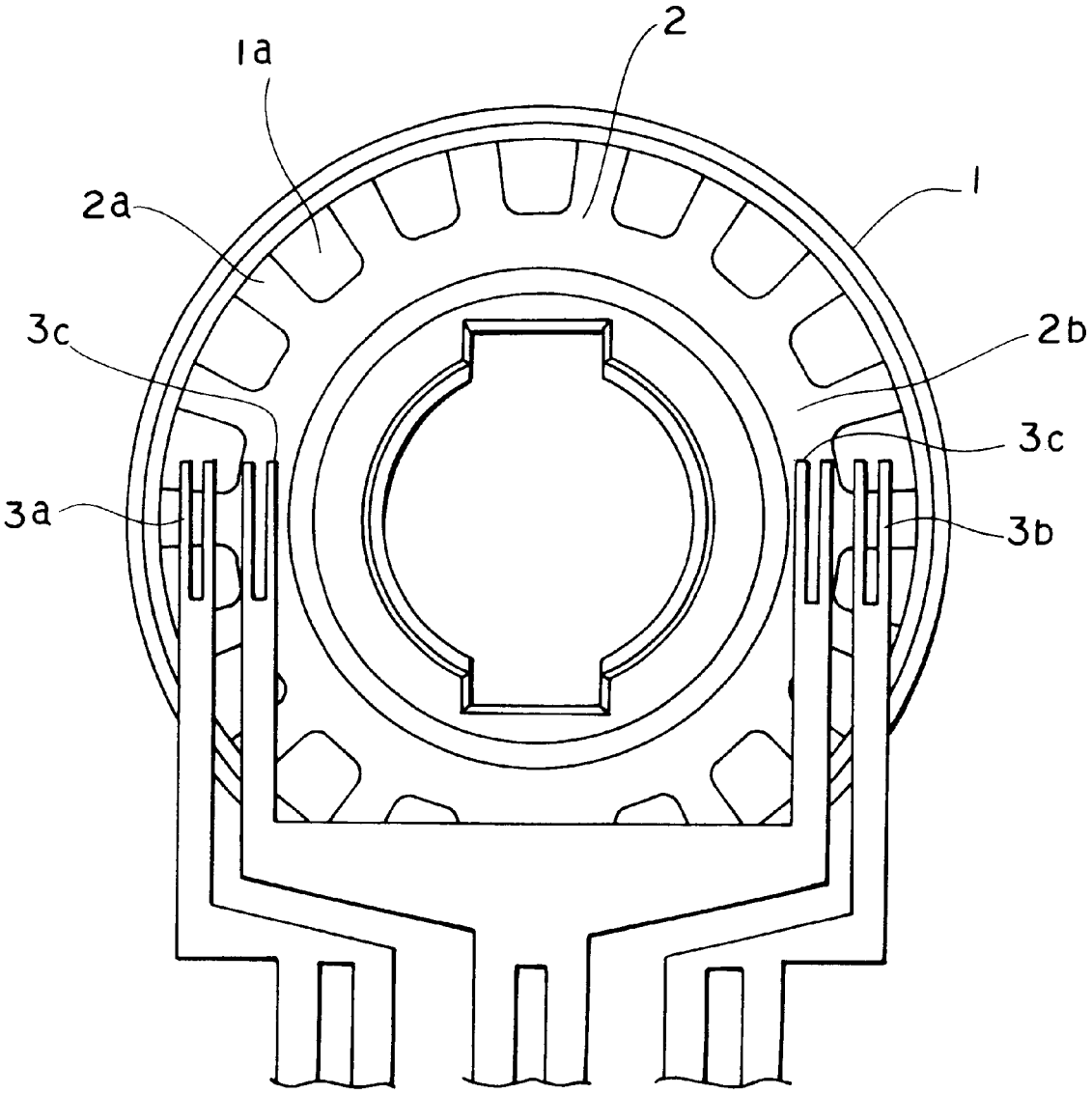
FIG. 2 is a plan view of an encoder switch of the present invention.

Next, the performance of encoder switches for which the conductive resin composition samples No. 1 to No. 30 are used will be described. FIG. 2 shows an embodiment of an encoder switch. A codeplate 1 of the encoder switch is a disk consisting of resin, a conductive pattern 2 consisting of the abovementioned conductive resin composition is formed on the surface 1*a* of the code plate 1, and the conductive pattern 2 is provided with a comb tooth portion 2*a* formed on the periphery of the code plate 1 and a ring portion 2*b* for linking the comb tooth portion 2*a*. The first and second slide brushes 3*a* and 3*b* and a common slide brush 3*c* of the encoder switch consist of phosphor bronze and a contact point for connecting to the conductive pattern 2 is clad with silver. When the encoder switch is operated, the code plate 1 is rotated, the first and second slide brushes 3*a* and 3*b* are in contact with the comb tooth portion of the conductive patterns respectively with a predetermined interval, and the common slide brush 3*c* is always in sliding-contact-with the ring portion of the conductive patterns.

In the encoder switch as described hereinabove, the rotation of the code plate 1 is detected based on the A-phase pulse signal that is the output difference between the output from the first slide brush 3*a* and the output from the common slide brush 3*c*, the B-phase pulse signal that is the output difference between the output from the second slide brush 3*b* and the output from the common slide brush 3*c*, and the differential signal between the A-phase pulse signal and the B-phase pulse signal.

Encoder switches were fabricated using the conductive resin composition samples No. 1 to No. 30 listed in Table 1, the initial output (g1-column and h1-column), the initial noise (g2-column and h2-column), and the service life (g3-column and h3-column) were measured for the fixed resistance of 10 kΩ and 100 kΩ connected to the encoder section respectively and are shown Table 1. The service life of the encoder switch means the number of signals generated during the time from operation starting of an encoder to operation ending when the encoder switch does not generate a normal pulse signal further.

As it is obvious from Table 1, in the case of the fixed resistance of 10 kΩ connected to the encoder section of an encoder switch, encoder switches that used samples No. 1, No. 4, and No. 5 having the conductive filler content (d-column) of 35% by weight or smaller and samples No. 25 to No. 30 containing only carbon beads conductive filler exhibited the small initial output (g1-column) from the beginning of operation starting, and did not generate the normal pulse signal due to noise (g2-column).

Though encoder switches that used samples No. 2 and No. 3 having high carbon black content (d-column) exhibited the small initial output (g1-column) and did not generate the normal pulse signal in spite of high conductive filler content of approximately 35% by weight, the noise level (g2-column) was low. The service life (g3-column) of encoder switches that used samples No. 22 to No. 24 having high conductive filler content (d-column) of approximately 61% by weight was as short as approximately 10,000 cycles.

The service life (g3-column) of encoders that used samples No. 6 to No. 21 having the conductive filler content (d-column) in the range from approximately 40% to 56% by weight was 50,000 cycles or longer, and this value suggests the suitability for practical use.

In the case of the fixed resistance connected to the encoder section of an encoder switch of 100 kΩ, the encoder switch that used sample No. 1 having the conductive filler content (d-column) of approximately 30% by weight exhibited the small initial output (h1-column) from the beginning of operation starting and did not generate the normal pulse signal due to the noise (h2-column). On the other hand, the service life of encoder switches that used samples No. 22 to No. 24 having the conductive filler content (d-column) of approximately 61% by weight was as short as 10,000 to 30,000 cycles because of wearing of the slide brushes 3*a*, 3*b*, and 3*c*. The service life (h3-column) of encoder switches that used samples No. 25 to No. 30 containing only carbon beads conductive filler was as short as 10,000 cycles. The service life of encoder switches that used samples No. 2 to No. 21 respectively having the conductive filler content (d-column) in the range from 34% to 56% by weight was 50,000 cycles or longer, and this value suggests the suitability for practical use.

In particular, the service life of encoder switches that used samples No. 13 and No. 16 having the conductive filler content (d-column) in the range from approximately 45% to 51% by weight and the high proportion of carbon beads in the conductive filler (the weight ratio of carbon beads to carbon black (e-column) was 6 to 7) was as extremely long as 220,000 cycles and 240,000 cycles respectively.

The service life of encoder switches that used samples No. 10 and No. 14 having the conductive filler content (d-column) in the range from approximately 45% to 51% by weight and the low proportion of carbon beads in the conductive filler (the weight ratio of carbon beads to the carbon black (e-column) was approximately 1) was as long as 100,000 cycles. The service life was significantly improved in comparison with encoder switches that used conductive resin compositions containing only carbon beads conductive filler (samples No. 25 to No. 30) and encoder switches that used conventional conductive resin compositions containing carbon black and graphite conductive fillers. Based on this fact, it is found that the weight ratio of carbon beads to carbon black equal to or larger than 1 is required to maintain the wear resistance of carbon beads of the conductive resin composition.

Based on the abovementioned result, it is found that the conductive resin composition containing carbon beads and carbon black conductive fillers in a binder resin consisting of phenolic resin in which the weight ratio of carbon beads to carbon black is in the range from approximately 1 to 8 and the conductive filler content is in the range from approximately 34 to 60% by weight brings about the low specific resistance and the long service life of the encoder switch for which the a abovementioned conductive resin composition is used.

Figure 3:
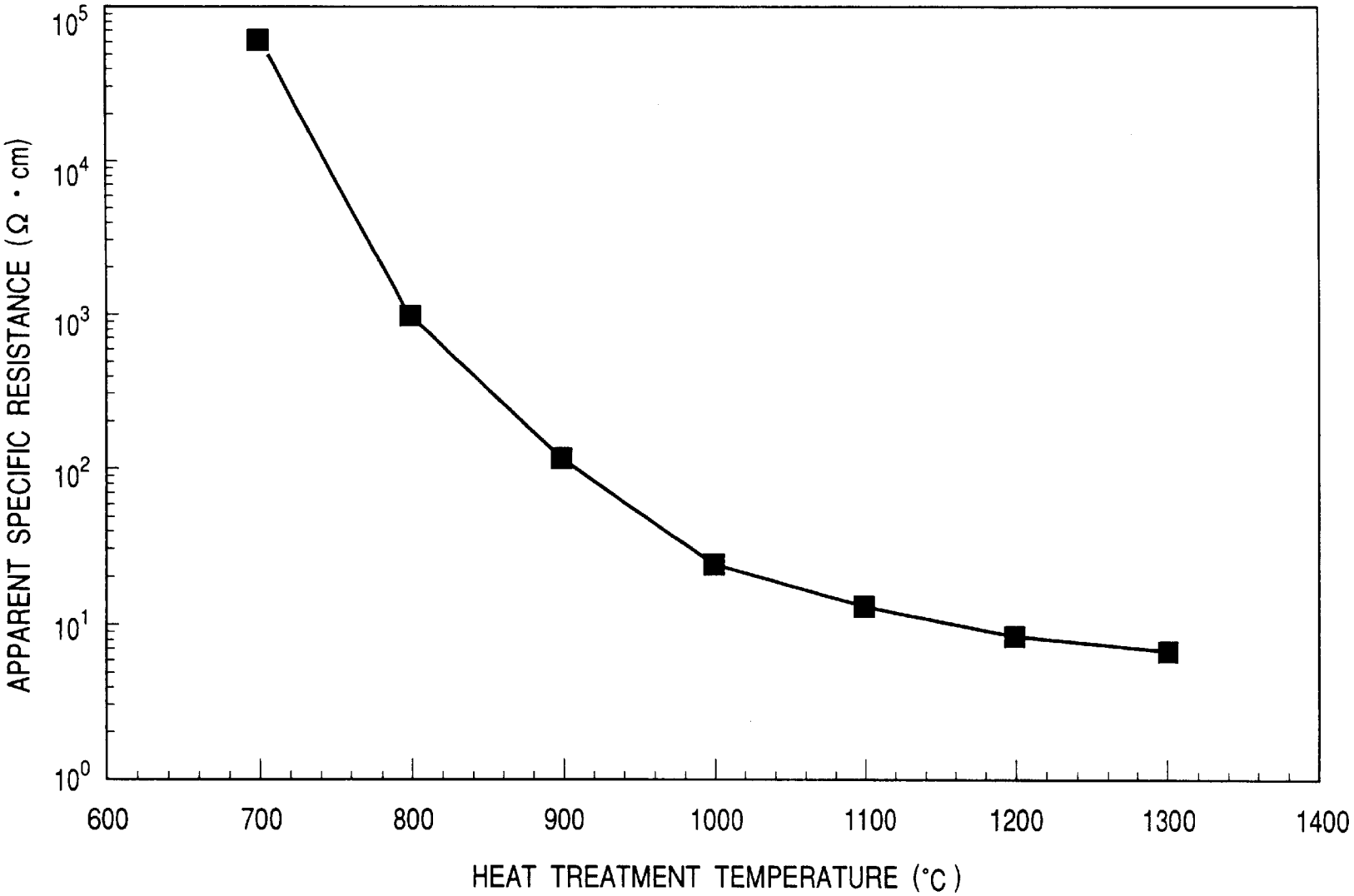
FIG. 3 is a graph showing the dependency of the specific resistance of carbon beads on the heat treatment temperature.

Meanwhile, as shown in the graph of FIG. 3, the specific resistance of the abovementioned carbon beads depends on the heat treatment temperature applied in manufacturing the carbon beads. The abscissa of the graph shown in FIG. 3 indicates the heat treatment temperature of carbon beads and the ordinate indicates the apparent specific resistance of the carbon beads. The apparent specific resistance of carbon beads was measured as described hereunder. Carbon beads that had been subjected to heat treatment were charged in a measuring cylinder having a flat bottom provided with a gold-plated electrode and compacted by means of repeated tapping until no volume change was observed, mercury was placed on the top, and the resistance value was measured. The measure value is converted to the apparent specific resistance based on the height after tapping and the diameter of the measuring cylinder. The conductivity was not obtained at the temperature of 600° C. or lower. It is found that the apparent specific resistance change is small between 1100° C. and 1300° C. The reason is likely that the micrographite structure does not develop between 1100° C. and 1300° C. The heat treatment temperature exceeding 1200° C. results in breakdown of the carbon beads due to strained rearrangement of molecules in carbonization. The heat treatment temperature of carbon beads is necessarily in the range from 700 to 1200° C. to obtain the conductivity with maintaining the spherical shape of the carbon beads.

EXAMPLE 2

Next, Example 2 in which the binder resin of the conductive resin composition consists of resol-type phenol resin and xylenic resin will be described. For all the samples No. 31 to 38 shown in Table 2, the conductive filler content was approximately 51% by weight, the weight ratio of carbon beads to carbon black was 1.9 commonly, but the weight ratio of resol-type phenol resin to xylenic resin (proportion of resol-type phenol resin to xylenic resin in the binder resin) shown in F-column of Table 2 or the type of xylenic resin shown in E-column of Table 2 (xylene resin, mesitylene resin) was different each other depending on the sample No.

TABLE 2

| No. | A | B | C | D | E | | F | G | H | J | K | L | M | |
|---|---|---|---|---|---|---|---|---|---|---|---|---|---|---|
| 31 | 12.02 | 6.39 | 1.9 | 17.7 | — | | — | 51 | 0.15 To 0.2 | Newtonian | 0.26 | 0.14 | 12 | Comparative Example |
| 32 | 12.01 | 6.39 | 1.9 | 17.14 | Mesitylene | 0.52 | 33 | 51 | 0.1 To 0.3 | Thixotropic | 0.25 | 0.15 | 12 | Example |
| 33 | 11.98 | 6.38 | 1.9 | 16.82 | Mesitylene | 0.8 | 21 | 51 | 0.17 To 0.2 | Pseudoplastic with yield point | 0.24 | 0.16 | 12 | Example |
| 34 | 12.04 | 6.38 | 1.9 | 16.83 | Xylene | 0.81 | 21 | 51.1 | 0.14 To 0.3 | Pseudoplastic with yield point | 0.24 | 0.16 | 12 | Example |
| 35 | 12.04 | 6.4 | 1.9 | 16.04 | Mesitylene | 1.78 | 9 | 50.9 | 0.46 To 0.8 | Pseudoplastic with yield point | 0.22 | 0.18 | 10 | Example |
| 36 | 12.04 | 6.39 | 1.9 | 15.13 | Mesitylene | 2.52 | 6 | 51.1 | 0.67 To 1 | Pseudoplastic with yield point | 0.23 | 0.17 | 10 | Example |
| 37 | 12.02 | 6.4 | 1.9 | 14.21 | Mesitylene | 3.55 | 4 | 50.9 | 0.64 To 1.3 | Pseudoplastic with yield point | 0.22 | 0.18 | 10 | Example |
| 38 | 12 | 6.38 | 1.9 | 8.86 | Mesitylene | 8.85 | 1 | 50.9 | 0.44 to 3.4 | Pseudoplastic with yield point | 0.23 | 0.17 | 6 | Example |

A quantity of carbon beads (g)
B quantity of carbon black (g)
C weight ratio of carbon beads to carbon black
D quantity of resol-type phenol resin (g)
E quantity of xylenic resin (g)
F weight ratio of phenol resin to xylenic resin
G conductive filler content (% by weight)
H specific resistance (Ω· cm)
J flow property
K measured line width (mm)
L measured gap width (mm)
M service life of encoder switch having fixed resistance of 10 kΩ (10,000 cycles)

The flow property of conductive inks that contain conductive resin composition samples listed in Table 2 in carbitol organic solvent was measured. For forming the fine pattern by means of screen printing, it is desirable that the viscosity of the conductive ink is low while the ink is being deformed by a load for pressing with a squeegee against the screen so that the flow property is suitable for printing and the viscosity becomes high after the ink is extruded through the screen mesh and the load is unloaded so the the pattern shape is maintained as printed.

Figure 4:
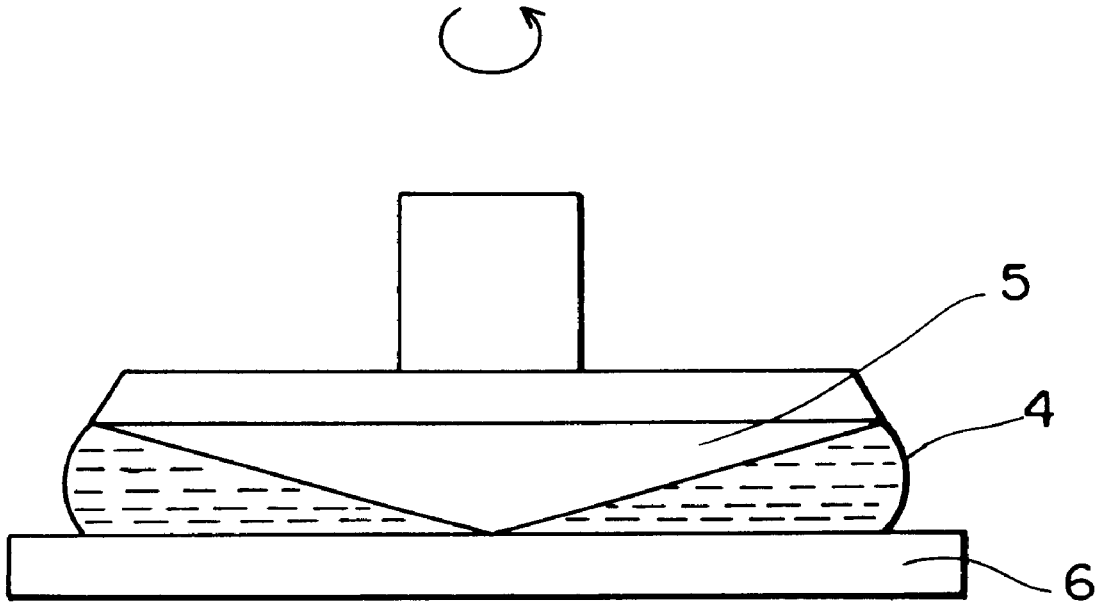
FIG. 4 is a schematic illustration of a cone-plate type viscometer.

The flow property of the conductive inks was measured by use of a cone-plate type viscometer as shown in FIG. 4. The conductive ink 4 is filled between a cone 5 and a plate 6, the rotation speed (the rate of shear) of the cone 5 that rotates with interposition of the conductive ink 4 corresponds to the deformation of the conductive ink 4, the force (shear stress) required to rotate the cone 5 at a constant rotation speed corresponds to the force that causes the deformation, and the proportional coefficient between the rate of shear and the shear stress indicates the viscosity.

As shown in J-column of Table 2, the flow property of the conductive ink of the sample No. 31 that did not contain xylenic resin shown the porportional relation between the shear stress and the rate of shear. This result suggest Newtonian flow characteristic that the viscosity of the conductive ink is constant regardless of the magnitude of the load loaded on the conductive ink.

In the case of the flow property of conductive ink samples No. 32 to 38 that contained mesitylene resin, the shear stress is not proportional to the rate of shear. This result suggests non-Newtonian flow characteristic that the viscosity of the conductive ink varies depending on the load loaded on the conductive ink.

In the case of the flow property of the conductive ink sample No. 32 that contained less mesitylene resin, the shear stress increases gradually with increasing rate of shear. This result suggests that the conductive ink viscosity decreases with increasing load loaded on the conductive ink. On the other hand, when the rate of shear turns from increase to decrease, the shear stress decreases in proportion to the rate of shear. This result suggests that the viscosity of the conductive ink is constant through the load loaded on the conductive ink decreases. Therefore, it is found that the conductive ink of Example 32 exhibits thixotropic flow characteristic that the viscosity decreases due to loading and it takes certain time for restoring the high viscosity from the time when the load is unloaded. In this case, because the viscosity is low while the ink is being deformed by a load for pressing with a squeegee against the screen so that the flow property is suitable for printing, the screen printing property is good.

In the case of the flow property of conductive ink samples No. 33 to 38 containing relatively more mesitylene resin or xylene resin, the shear stress increases gradually with increasing rate of shear. This shows the viscosity decrease of the conductive ink with increasing load loaded on the conductive ink. On the other hand, when the rate of shear turns from increase to decrease, the shear stress decreases gradually with decreasing rate of shear. This shows that the viscosity increases with decreasing load loaded on the conductive ink. Therefore, it is found that the flow property of the conductive ink is pseudoplastic property that the viscosity becomes low when a load is loaded on the conductive ink and the conductive ink restores the original viscosity immediately after the load is unloaded.

In the case of the flow property of the conductive ink samples No. 32 to 38, the finite yield value can be estimated by means of the theoretical equation of pseudoplastic flow (for example, Casson equation). This means that the conductive ink flows (deform) only when a load having the magnitude larger than a certain value is loaded, if the magnitude value is larger than the gravity that will cause sagging, then the ink can maintain the printed pattern against the gravity. If the flow property of the conductive ink is pseudoplastic with yield value, the viscosity is low while the ink is being subjected to a load loaded by means of a squeegee against to a screen so that the ink is suitable for printing, on the other hand the viscosity becomes immediately high so that the ink does not flow after the ink is extruded through the screen mesh and the load is unloaded, as the result the conductive ink holds the pattern shape continuously as screen-printed. In the case of having the yield value, because (gravity-yield value) corresponds to the shear stress, the conductive ink is further difficult to flow.

The conductive ink samples No. 31 to 38 having the abovementioned flow property were printed by use of a metal mask having the pattern width of 0.2 mm and the gap width of 0.2 mm and cured, and the line width and the gap width were measured to obtain the measured result listed in K-column and L-column of the Table 2 respectively.

As obvious from Table 2, the measured line width (K-column) becomes narrow to be close to 0.2 mm that is the pattern line width of the mask as the weight ratio (F-column) of resol-type phenol resin to mesitylene resin decreases, that is, as the content of mesitylene resin increases. The measured line width (K-column) of conductive ink samples No. 33 to No. 38 that are pseudoplastic fluid having the yield value ranges from 0.22 mm to 0.24 mm, the pattern shape as just screen-printed is maintained, and these conductive inks are excellent in pattern accuracy.

Next, the specific resistance of conductive resin composition samples No. 31 to 38 is shown in H-column of Table 2. The specific resistance was measured in the same manner as used for samples No. 1 to No. 30. It is found from Table 2 that the specific resistance (H-column) increases with decreasing weight ratio of resol-type resin to xylenic resin (F-column), namely, with increasing mesitylene resin in the binder resin. The likely reason is that the mesitylene resin added to the binder resin prevents the resol-type phenol resin from cure-shrinking and the contact pressure between conductive filler particles is lowered. However, the specific resistance (H-column) of conductive resin composition samples No. 32 to 38 is as low as 3.4Ω or smaller, in the case of samples No. 32 to 34 having the weight ratio (F-column) of resol-type phenol to xylenic resin is 21 or larger, little deterioration of the specific resistance (H-column) due to addition of xylenic resin is observed.

Next, the service life of encoder switches for which conductive resin composition samples No. 31 to 38 were used is listed in M-column of Table 2. The structure of the encoder switches is the same as those used for samples No. 1 to No. 30.

From Table 2, it is found that the service life (M-column) of the encoder switch is shorter with decreasing weight ratio (F-column) of resol-type phenol resin to mesitylene resin, namely, with increasing mesitylene resin in the binder resin. The likely reason is that thermoplastic mesitylene resin contained in the binder resin causes slight deterioration of the heat resistance of the conductive resin composition. However, the service life (M-column) of encoder switches for which samples No. 32 to 38 were used is as well as 60,000 or more and this value suggests the suitability for practical use. The service life (M-column) of encoder switches for which samples No. 32 to No. 34 having the weight ratio (F-column) of resol-type phenol resin to xylenic resin of 21 or larger were used is not different from that for which the sample No. 31 containing no xylenic resin was used.

From the result described hereinabove, it is found that the conductive resin composition containing mesitylene resin or xylenic resin as the binder resin is excellent not only in pattern accuracy but also in conductivity and wear resistance, and it is suitable for fine pattern forming. In particular, the weight ratio of phenol resin to xylenic resin in the range from 1 to 21 is suitable for accurate fine pattern forming. The weight ratio of phenol resin to xylenic resin in the range from 4 to 31 is suitable for obtaining excellent conductivity, wear resistance, and pattern width accuracy together.

Because the conductive resin composition of the present invention contains both carbon beads and carbon black as the conductive filler in phenolic resin served as the binder resin and the conductive filler content is in the range from 34 to 60% by weight, not only excellent conductivity but also excellent wear resistance is obtained.

Because the conductive resin composition of the present invention contains xylenic resin, phenolic resin, carbon beads, and carbon black and the weight ratio of the phenolic resin to the xylenic resin is in the range from 1 to 33, not only excellent conductivity and wear resistance but also fine pattern accuracy is obtained.

Because the encoder switch of the present invention uses the abovementioned conductive resin composition, the encoder switch of less noise in output signal and long service life is realized and the miniaturized encoder switch is realized because the fine and accurate conductive pattern can be formed.

What is claimed is:

1. A conductive resin composition comprising:

a binder resin consisting essentially of phenolic resin and a conductive filler, the conductive filler having carbon beads and carbon black, wherein the conductive filler content is in the range from 45 to 51% by weight.

2. The conductive resin composition according to claim 1, wherein the weight ratio of the carbon beads to carbon black is in the range from 1 to 8.

3. The conductive resin composition according to claim 2, wherein the carbon beads are spheres having a diameter of 1 to 30 $\mu$m.

4. The conductive resin composition according to claim 3, wherein the carbon beads contain heated and carbonized thermosetting resin powder, and a heat treatment temperature of the thermosetting resin powder is in the range from 700 to 1200° C.

5. The conductive resin composition according to claim 1, wherein the binder resin contains xylenic resin.

6. An encoder switch comprising the conductive resin composition according to claim 1.

* * * * *